US007083453B2

(12) United States Patent
Herring et al.

(10) Patent No.: US 7,083,453 B2
(45) Date of Patent: Aug. 1, 2006

(54) FLOATING CONNECTOR SPRING AND ASSEMBLY

(75) Inventors: Dean F. Herring, Youngsville, NC (US); Angela Lopez, Mission, TX (US); Tony C. Sass, Fuquay Varina, NC (US); Paul A. Wormsbecher, Apex, NC (US)

(73) Assignee: Lenovo (Singapore) Pte. Ltd. (SG)

( * ) Notice: Subject to any disclaimer, the term of this patent is extended or adjusted under 35 U.S.C. 154(b) by 0 days.

(21) Appl. No.: 11/026,952

(22) Filed: Dec. 30, 2004

(65) Prior Publication Data

US 2006/0148293 A1 Jul. 6, 2006

(51) Int. Cl.
*H01R 13/64* (2006.01)

(52) U.S. Cl. ..... 439/247; 248/660; 248/671

(58) Field of Classification Search ..... 439/246–248; 248/638, 660, 661, 665, 671, 674
See application file for complete search history.

(56) References Cited

U.S. PATENT DOCUMENTS 4,334,732 A * 6/1982 Roeschlein et al. ..... 439/248
4,361,372 A 11/1982 Majkrzak et al. ..... 439/247
4,647,129 A * 3/1987 Kandybowski et al. ..... 439/246
4,697,859 A 10/1987 Fisher, Jr. ..... 439/246
5,201,663 A * 4/1993 Kikuchi et al. ..... 439/83
5,318,455 A 6/1994 Villiers et al. ..... 439/248
5,328,381 A * 7/1994 Seymour et al. ..... 439/247
5,344,332 A 9/1994 Lopez et al. ..... 439/248
6,030,242 A 2/2000 Cunningham et al. ..... 439/247
6,155,858 A * 12/2000 Ozawa et al. ..... 439/248
6,159,030 A * 12/2000 Gawron et al. ..... 439/247
6,491,536 B1 * 12/2002 Torii ..... 439/246

OTHER PUBLICATIONS

Thomson Derwent printout dated Jul. 13, 2004 with abstracts of various U.S. and foreign patents.

* cited by examiner

*Primary Examiner*—Gary Paumen
(74) *Attorney, Agent, or Firm*—Scott W. Reid; Synnestvedt & Lechner LLP

(57) ABSTRACT

A floating connector spring capable of movement in multiple degrees of freedom to enable the mating of at least two connectors that may be misaligned relative to one another. The connector spring includes first and second arms spaced form one another and extending substantially in the same direction. The first and second arms each have a lobe section between their distal and proximal ends, which are resiliently deformable to allow movement of the distal ends relative to the proximal ends of the respective arms. The movement permitted includes linear and rotational movement in up to six degrees of freedom depending on the configuration of the invention used. The connector spring can further include a third arm extending perpendicular from the first and second arms and which includes a third lobe section for movement in an additional degree of freedom. The connector spring can fixedly hold a connector, such as an electrical connector, and can further include a restrainer for limiting the range of motion of the spring.

19 Claims, 10 Drawing Sheets

FLOATING CONNECTOR SPRING AND ASSEMBLY

BACKGROUND OF THE INVENTION

The present invention relates generally to connectors for connecting two bodies and, more particularly, to a connector assembly and spring that compensates for misalignment between the two bodies to be connected. The present invention is particularly relevant for electrical connectors.

DESCRIPTION OF THE RELATED ART

The mechanical mating/connection of two bodies, such as electrical connectors, generally requires that the two bodies be aligned within given positional tolerances. Any misalignment between the two bodies may make the attempted mating difficult if not impossible. For example, in electronic equipment, such as computers or servers, two circuit boards may need to be electrically connected via electrical connectors that are mounted in a fixed position to their respective circuit boards (as opposed to connectors attached to flexible or ribbon cable harnesses which are flexible and easily manipulated by hand for manual mating). One board may be installed within the housing and the other board slid into position such that its connector blindly mates with the connector of the other board. The connectors, fixedly or rigidly mounted on their respective circuit boards, may be out of alignment in any of six degrees of freedom due to manufacturing tolerances, and thus unable to properly mate.

Various devices have been developed previously for aligning rigidly mounted connectors for mating. Nevertheless, none of them can sufficiently compensate for a connector that may be out of alignment in up to six degrees of freedom. Accordingly, the present invention overcomes these shortcomings with existing connectors.

SUMMARY OF THE INVENTION

The present invention provides a novel floating connector spring that allows a connector body to move in multiple degrees of freedom as necessary to compensate for any misalignment between the two connector bodies to be mated. Broadly, the connector spring includes first and second spring arms spaced from one another and which extend substantially in the same direction. Each of the first and second spring arms have a proximal end and a distal end and at least one lobe section disposed between the proximal and distal ends, and each of the lobe sections are configured to be resiliently deformable, including being expandable and compressible, to allow movement of the distal ends relative to the proximal ends of the first and second spring arms. The connector is preferably mounted between the first and second arms adjacent the distal ends of the arms.

The floating connector spring can further include a third arm having a distal end and a proximal end, and which is attached to and extends from the first and second arms in a direction different from the direction that the first and second arms extend. The third arm has at least one resiliently deformable lobe section between its distal and proximal ends to allow movement of the proximal end relative to the distal end of the third arm. In further embodiments, a restrainer can be provided to limit and/or control the movement of the spring arms.

BRIEF DESCRIPTION OF THE DRAWINGS

The accompanying drawings, which are incorporated in and constitute a part of the specification, illustrate a presently preferred embodiment of the invention. Together with the general description given above and the detailed description of the preferred embodiment given below, they serve to explain the principles of the invention.

DETAILED DESCRIPTION OF THE PREFERRED EMBODIMENTS

The present invention is now described with reference to an electrical connector assembly. Although a connector assembly as used with an electrical connector is described for illustrative purposes, the present invention is not so limited. For example, the present invention may apply equally to other bodies to be connected where the bodies are misaligned.

Figure 1:
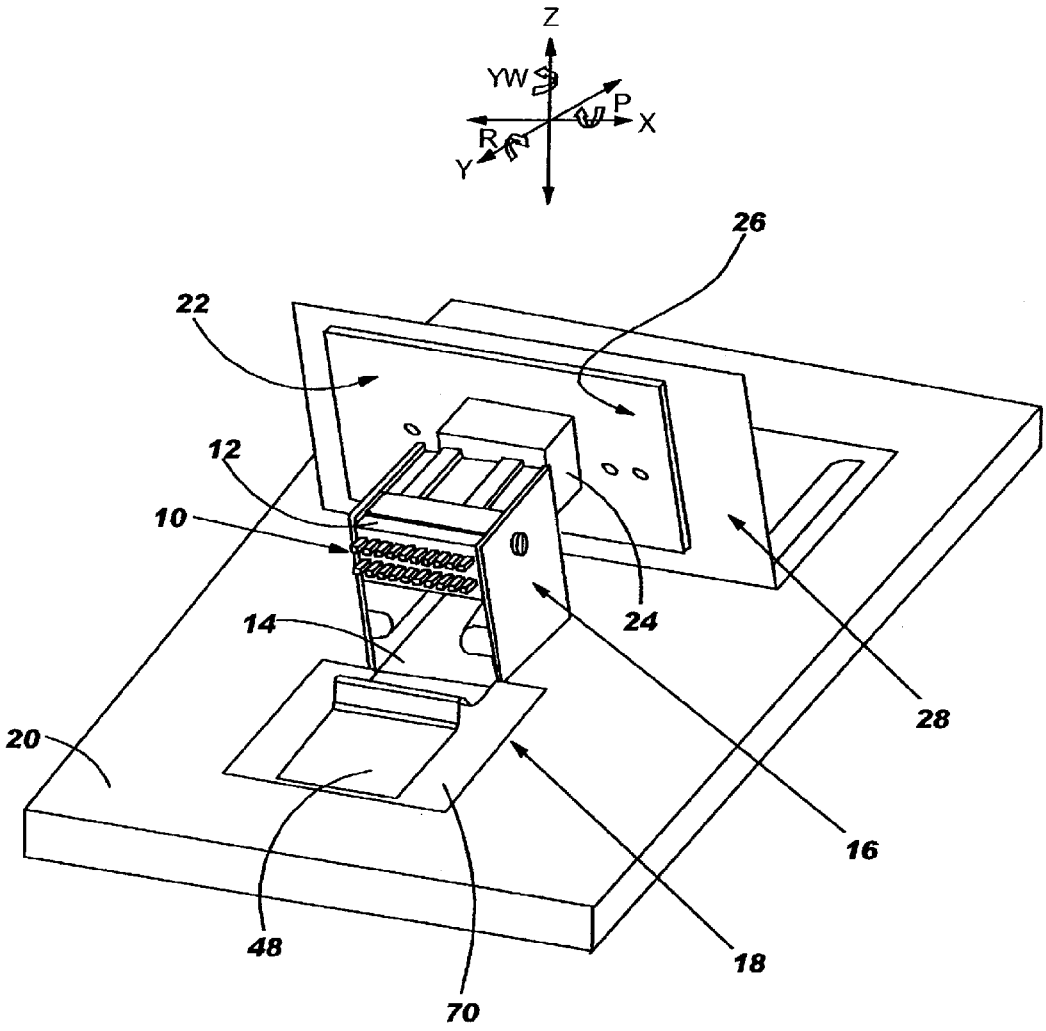
FIG. 1 is perspective view of a connector to connector mating system which shows a connector assembly in accordance with the present invention.

With reference to FIG. 1, a presently preferred connector to connector mating system incorporating the present invention is illustrated. A first connector assembly 10 includes an electrical connector 12, a floating connector spring 14 to which the electrical connector 12 is mounted, and a restrainer 16 positioned to limit the movements of the connector spring 14. The connector spring 14 in combination with the restrainer 16 is referred to herein as a spring/restrainer assembly 18. The connector assembly 10 is mounted to a base 20 and allows the connector 12 to move in any of six degrees of freedom as necessary for alignment when mating to another connector as is described below in more detail.

Mounted to the base 20 opposite the connector 12 on a second connector assembly 22 is a complimentary connector 24 configured for mating with the connector 12. The complimentary connector 24 is conventionally mounted and is capable of moving toward the connector 12 to mechanically connect with it, the connector 24 being mounted on a header board 26 which in turn is mounted on a mounting plate 28 which is slidable relative to the base 20. As the connector 12 and complimentary connector 24 are brought together, any misalignment between the two, such as that which is due to manufacturing tolerances of the conventional connector 24, is accommodated by the floating connector spring 14 which allows movement of the connector 12 in any of the six degrees of movement as necessary to compensate for the misalignment. This configuration of connectors could, for example, be electrical connectors within a server where circuit boards at right angles to each other are electrically and physically connected by such connectors. The connector assembly 10, which includes the connector 12, the connector spring 14 and restrainer 16, is now described in more detail.

Figure 2:
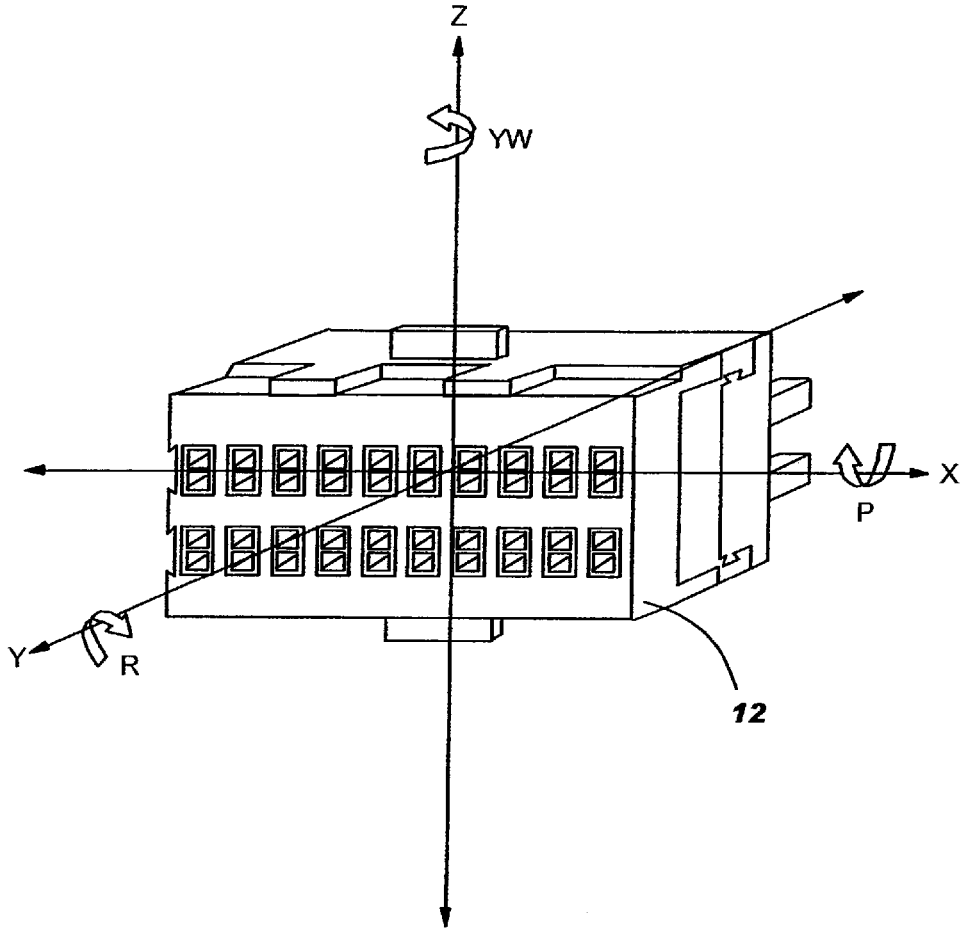
FIG. 2 is a perspective view of the connector shown in FIG. 1.

Shown in FIG. 2 is the electrical connector 12 isolated from the connector assembly 10 (see FIG. 1). This type of connector 12 is shown for illustrative purposes as it is understood that any type of connector (including any other object to be connected), can be used. Also illustrated are the six degrees of freedom in which a connector may be misaligned as it mates with another connector due to various reasons including manufacturing and tolerance build-ups. For example, due to misalignment, connection of the two connectors 12 and 24 may require the connector 12 to move in any or all of the six degrees of freedom to compensate for misalignment of the connector 24. These six degrees of freedom are described herein with reference to three axes which are perpendicular (orthogonal) to each other and which are referred to herein as X, Y, and Z axes as shown and as known in the three dimension Cartesian coordinate system. The six degrees of freedom include the three linear degrees of movement along the X, Y, Z axes as indicated by the arrows at the ends of the axes (each axis representing two linear directions as indicated by the arrows at opposite ends of each axis), and includes the three rotational degrees of movement about each of these axes and named conventionally as pitch P (about the X axis), roll R (about the Y axis), and yaw YW (about the Z axis), there being two directions of rotation for each axis, e.g., clockwise and counterclockwise yaw about the Z axis.

Figure 3:
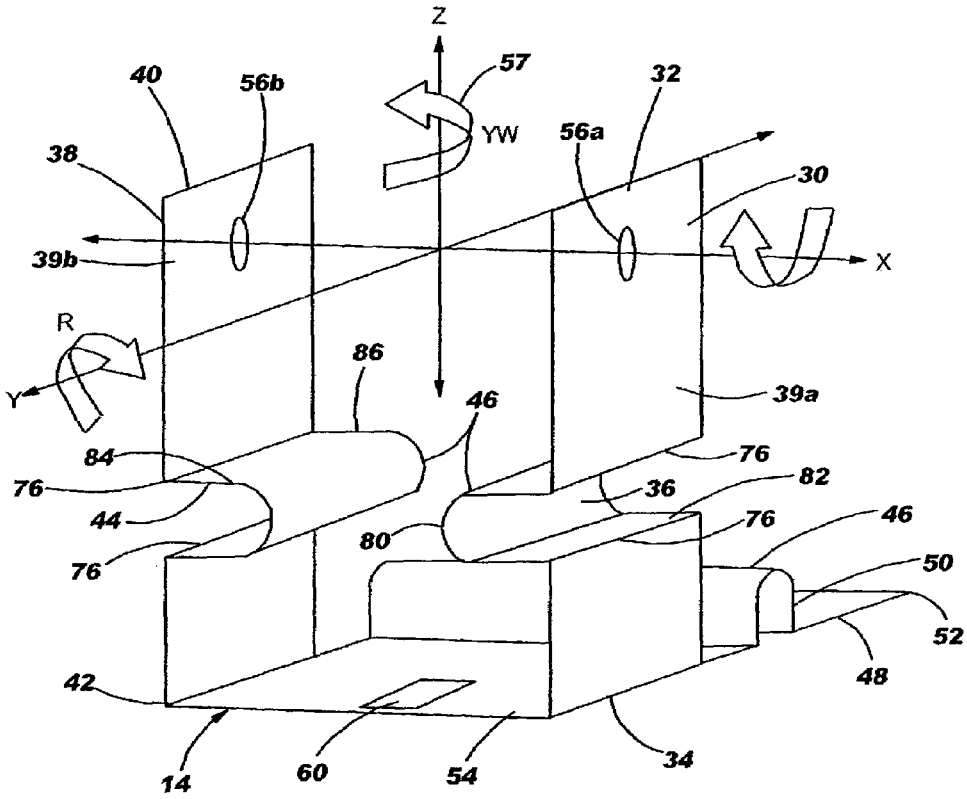
FIG. 3 is perspective view of the floating connector spring shown in FIG. 1.

With reference to FIG. 3, the floating connector spring 14, which provides for movement in up to the six degrees of freedom, is now described. The floating connector spring 14, to which the connector 12 is preferably fixedly mounted, has a first arm 30 extending substantially in the Z direction (upwardly in a direction of the Z axis as shown). It has a distal end 32 and a proximal end 34. A first lobe section 36 is formed in the arm 30 between the distal end 32 and proximal end 34 as shown to allow movement of the distal end 32 relative to the proximal end 34. Similarly, the floating connector spring 14 also has a second arm 38 extending substantially in the Z direction and has a distal end 40 and a proximal end 42. A second lobe section 44 is formed in the arm 38 between the distal end 40 and proximal end 42 as shown to allow movement of the distal end 40 relative to the proximal end 42.

The first and second spring arms 30, 38 are preferably formed as flat spring arms from which the lobe sections extend as shown. As flat members, the first and second arms 30, 38 extend in first and second planes 39*a*, 39*b* defined by the arms 30, 38 and which are generally parallel to one another. Resilient materials such as spring steel and plastics capable of acting as a spring can be used, depending of the spring forces involved in the particular application. As will be described in further detail below, the lobe sections 36, 44 are configured to be resiliently deformable (spring like action urging the deformed members back to their original position), including being expandable and compressible, to allow movement of the distal ends 32, 40 relative the proximal ends 34, 42 of the springs arms 30, 38. Each of the lobe sections 36, 44 preferably have a rounded section 46 and extend in a direction away from the respective arms 30, 38, and preferably in a direction substantially perpendicular, in a direction of the X axis, from their respective arms 30, 38 as shown. For example, the first arm lobe section 36 extends substantially in a direction of the X axis which is perpendicular to the Z direction in which the spring arm 30 extends. Moreover, in the preferred embodiment shown, the first and second lobe sections 36, 44 extend towards each other, substantially in the directions of the X axis, along a common plane (put another way, the lobe sections 36 and 44 extend towards each other at a similar elevation above the proximal ends of the arms 30 and 38, respectively). While, other configurations for the lobe sections 36, 44 may be possible, e.g., a non-rounded lobe section 46 such as an angular section, a rounded section such as that shown is believed to provide a smoother bending action and more uniform distribution of stress when deformed, e.g., expanded. The edges 76 of the lobe sections 36, 44 are referenced in FIG. 3 for further description below.

The floating connector spring 14 preferably has a third arm 48 extending in a direction different from the direction of the first and second arms 30, 38, and preferably extends substantially in a direction of the Y axis from and attached to the proximal ends 34, 42 of the first and second arms 30, 38 as shown. The third arm 48 has a third lobe 50 extending in a direction away from the Y axis, and extending preferably substantially upward in a direction of the Z axis as shown. The third lobe section 50 is positioned preferably between a distal end 52 and a proximal end 54 of the third arm 48. The third lobe section 50, similar in configuration to the lobe sections 36, 44, is resiliently deformable, including being expandable and compressible, such that the proximal end 54 can move linearly relative to the distal end 52 in the directions of the Y axis, moving the first and second arms 30, 38 with it in the linear direction of the Y axis. The lobe section 50 extends upwardly in the illustrated embodiment as shown so that the third arm 48 can be mounted flush onto a support, such as the restrainer 16 in this particular embodiment (see FIGS. 1 and 4). Similar to the first and second arms 30, 38, the third arm 48 is preferably formed as a flat spring arm from which the third lobe section 50 extends, and has a rounded section 46. In the preferred embodiment, the first, second, and third arms 30, 38, 48 are integrally formed as a unitary spring.

Adjacent the distal ends 32, 40 of the first and second arms 30, 38 are openings 56*a*, 56*b* through which respective studs 58*a*, 58*b* (FIGS. 1, 4), such as pins, can extend for restraining purposes as further described below. The openings 56*a*, 56*b* should be similar in size to the studs 58*a*, 58*b* to ensure that the connector spring 14 is securely attached to the connector 12 so as to move therewith. Adjacent the proximal end 54 of the third arm 48, between the first and second spring arms 30, 38 is a slotted opening 60 (FIG. 3) which can also be used for restraining purposes as further described below.

Figure 4:
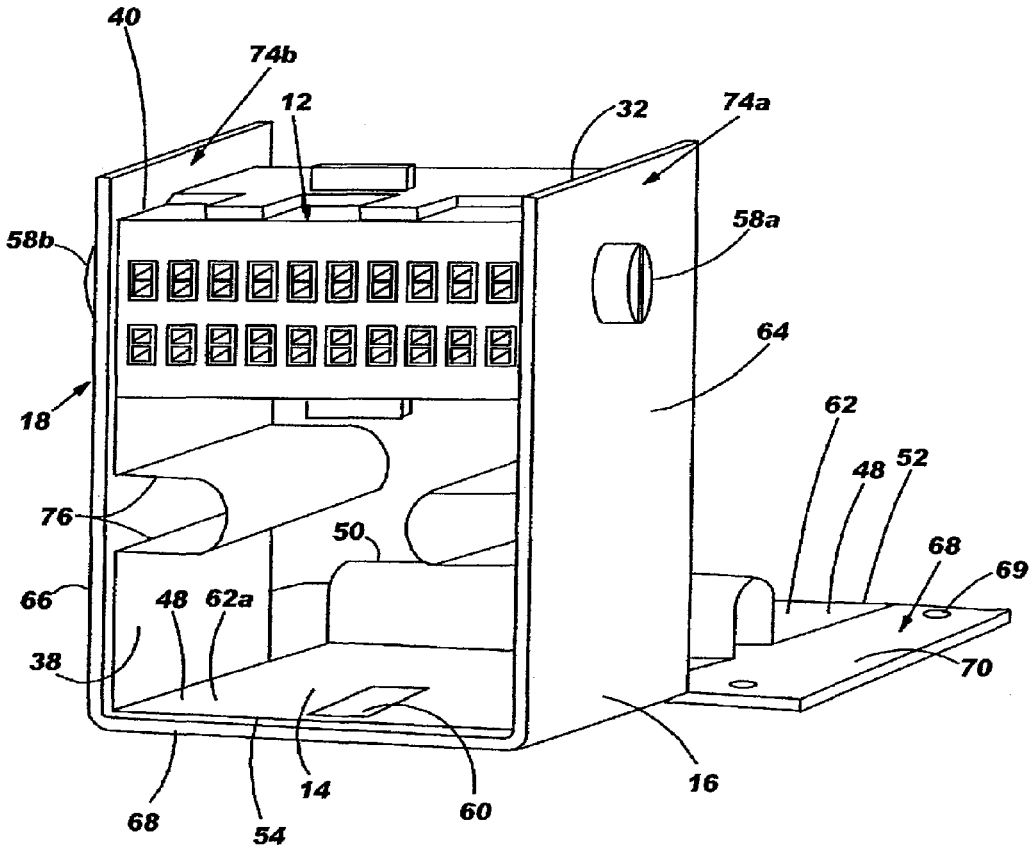
FIG. 4 is perspective view of the floating connector spring of FIG. 3 shown mounted within the restrainer.

A means for restricting the movement of the connector spring 14 to a predefined tolerance limit is provided in the present embodiment by the restrainer 16. FIG. 4 shows a spring/restrainer assembly 18 which includes the spring 14 and restrainer 16. With further reference to FIGS. 1, 3, 5A and 5B, the floating connector spring 14, with the connecter 12 fixedly attached to the spring 14 between the two spring arms 30 and 38 adjacent the distal ends 32, 40, is mounted within the restrainer 16 to limit the range of motion of the connector 12. The restrainer 16 has a first restrainer arm 64 extending adjacent to and spaced from the first spring arm 30 on the right side of the arm 30 as oriented in FIG. 4, extending substantially in a direction of the Z axis, so as to limit the movement of the first spring arm 30 to the right, and a second restrainer arm 66 adjacent to and spaced from the second spring arm 38 on the left side of the arm 38, extending substantially in a Z direction, so as to limit the movement of the second spring arm 38 to the left. A bottom member 68 extends between and connects the two restrainer arms 64, 66 and includes a tail end 70 extending rearward away from the arms 64, 66, substantially in the a direction of the Y axis.

In the preferred embodiment, the connector spring 14 is mounted directly to the restrainer 16. The third spring arm 48 is mounted on top of the restrainer bottom member 68 between the restrainer arms 64, 66 (as seen in FIG. 4), the section 62 of the third arm 48 on the distal end 52 side of the lobe section 50 being attached or affixed to the tail end 70 in any suitable manner, such as by welding, screws, fasteners, adhesive, or any other suitable attachment means. This permits the section 62*a* of the third arm 48 on the proximal side 54 of the lobe section 50 to move linearly in the directions of the Y axis relative to the distal end 52, being slidable over the restrainer bottom member 68. If the restrainer 16 were not used, then the spring 14 could be attached directly to the base 20 (see FIG. 1).

The restrainer 16 limits the freedom of movement of the connector spring 14 by acting as a stop at predetermined tolerances. It can be made of any suitable stiff material capable of preventing movement of the floating connector spring 14. The restraining studs 58*a*, 58*b*, here formed preferably as the cylindrical pins shown, other shapes and configurations being suitable, are attached to or formed as part of the connector 12 and extend through the openings 56*a* and 56*b* in the two connector spring arms 30 and 38, and extend further through openings 74*a*, 74*b* in the restrainer arms 64 and 66. The configuration and size of the openings 74*a*, 74*b* in the restrainer arms 64 and 66 relative to the size of the studs 58*a*, 58*b*, as well as the spacing between the connector spring arms 30, 38 and respective adjacent restrainer arms 64, 66 control and limit the movement of the connector 12. For example, with reference to FIG. 5, the greater the space between the connector spring arms 30, 38 and the respective adjacent restrainer arms 64, 66, the greater the potential linear movement of the connector 12 in the directions of the X axis. Similarly, the larger the restrainer openings 74*a*, 74*b* relative to the size of the studs 58*a*, 58*b*, the more the connector 12 can roll about the Y axis, yaw about the Z axis, pitch about the X axis, or move linearly in the directions of the Y and Z axes. It is also understood that the configuration of the restrainer openings 74*a*, 74*b* can be used to further define and limit the movement of the connector 12. For example, circular openings 74*a*, 74*b* permit one range of motion while a more slotted opening longer in the directions of the Z axis will permit a greater range of linear motion in the directions of the Z axis. The movement of the connector spring 14 can be further restricted by adding a hold down member (not shown), such as a fastener with a head, e.g. a screw, through the slotted opening 60 in the spring third arm 48. Preferably fixed to the restrainer 16, such a hold down member allows the connector spring 14 to move back and forth linearly in the directions of the Y axis, while preventing the spring 14 from lifting up. The slotted opening 60 is configured to permit the desired linear motion, the longer the slot in a direction of the Y axis, the greater the movement in the directions of the Y axis allowed. Other means for controlling movement are also available, such as choosing a connector spring material or thickness having a stronger or weaker spring stiffness. The studs 58*a*, 58*b* can also be used to fix the connector 14 to the floating connector spring 14. For example, the studs 58*a*, 58*b* may have a non circular cross section, such as a square or rectangular cross section, fitted tightly in complimentary shaped openings 56*a*, 56*b* in the floating connector spring 14. This would prevent the connector 12 from rotating relative to the spring 14. Adhesive or other fastening means, such as mechanical fastening means, may also be used to fixedly attach the connector 12 to the floating connector spring 14.

Thus it is seen that the connector spring 14, with the connector 12 fixedly attached to it, provides up to six degrees of freedom to allow the connector 12 to move as necessary to mate with another connector 24. Preferably, the spring 14 is used with the restrainer 16 to provide a predefined range of movement and to insure that the connector 12 is within a predetermined area to effect mating with the second connector 24. In this use the connector spring 14 is preferably mounted to the restrainer 16, i.e., the rear section 62 of the third arm 48 is fixedly attached to the tail section 70 of the restrainer 16, and the restrainer 16 is mounted to the base 20. The tail section 70 includes mounting holes 69 for mounting the restrainer 16 to the base 20 by any suitable means, such as screws, rivets, etc. Where a restrainer 16 is not desired or necessary, such as applications where greater range of movement is desired, the spring 14 can by used without the restrainer 16 by mounting the connector spring 14 directly to the base 20.

Movement of the connector 12 in the various degrees of freedom is now illustrated with further reference to FIGS. 5 through 9A. As will be seen, the two arms 30 and 38 permit movement in five of the degrees of freedom, linear along the Z and X axes and rotation about the X, Y and Z axes. The third arm 48, via its lobe section 50, permits linear movement in the directions of the Y axis. As will be seen, the lobe sections can deform to aid in the various movements of the connector 12. These movements are now described in more detail.

Figure 5:
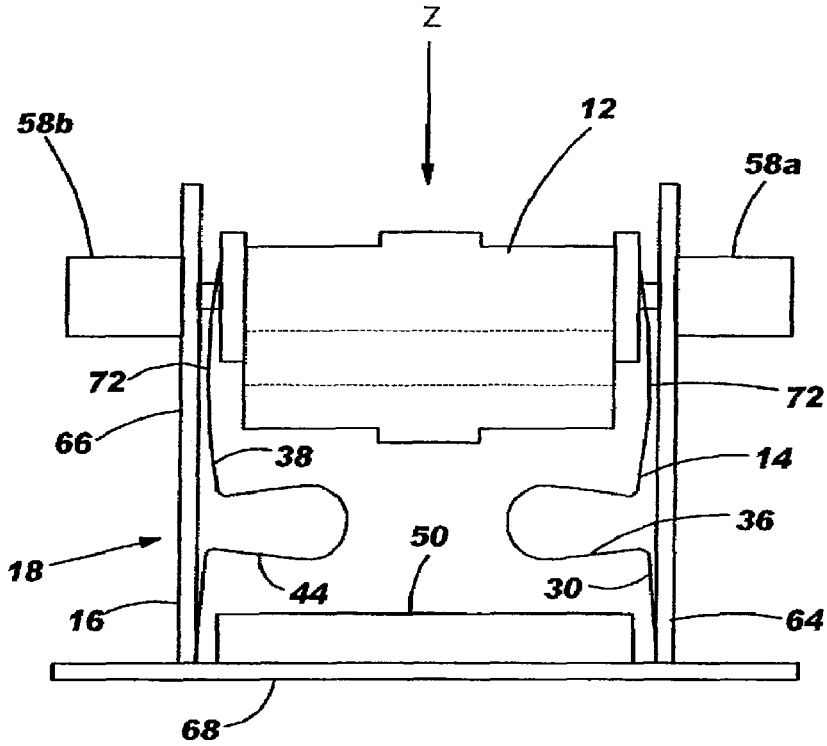
FIGS. 5 and 5A are plan views of the connector assembly of FIG. 4 illustrating linear movement in the directions of the Z axis.
Figure 5A:
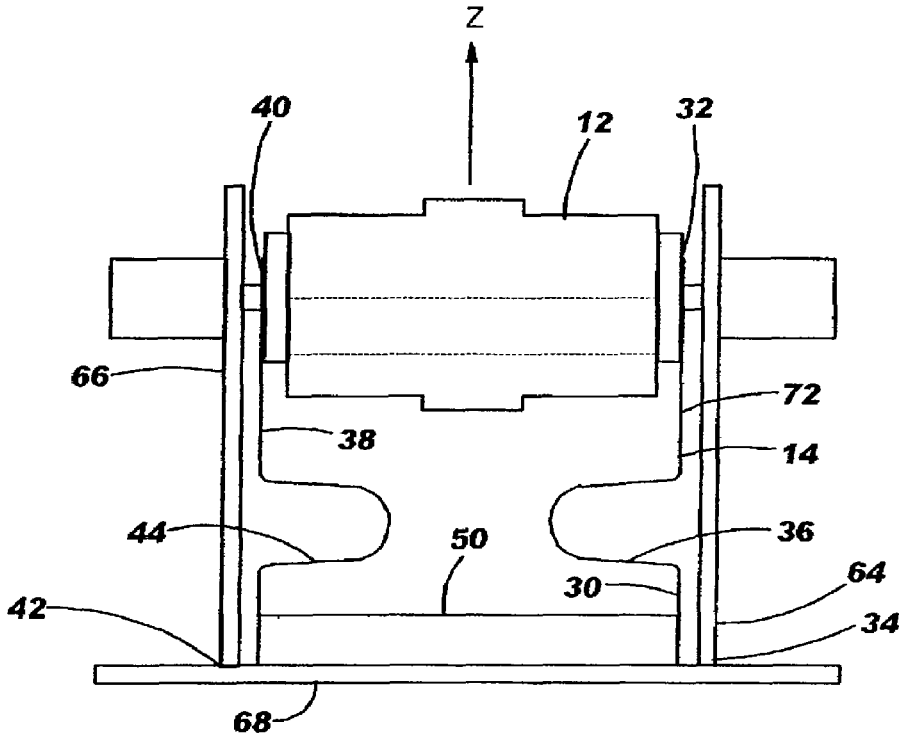

With particular reference to FIG. 5, downward linear movement of the connector 12 along the Z axis is permitted by the compression of the lobe sections 36, 44 with some slight bowing of the section 72 of the spring arms above the lobe sections 36, 44. Similarly, with reference to FIG. 5A, upward linear movement of the connector 12 along the Z axis is permitted by the expansion of the lobe section 36, 44. With further reference to FIG. 4, if the front proximal section 62*a* of the third arm 48 is not held down by means of a hold down member in the slot 60 as discussed above, additional upward movement along the Z axis is possible by means of the third arm 48 rising above the retainer bottom plate 68. In the preferred embodiment shown, the downward or upward movement of the connector 12 is limited by the movement of the studs 58*a*, 58*b* within the openings 56*a*, 56*b*.

Figure 6:
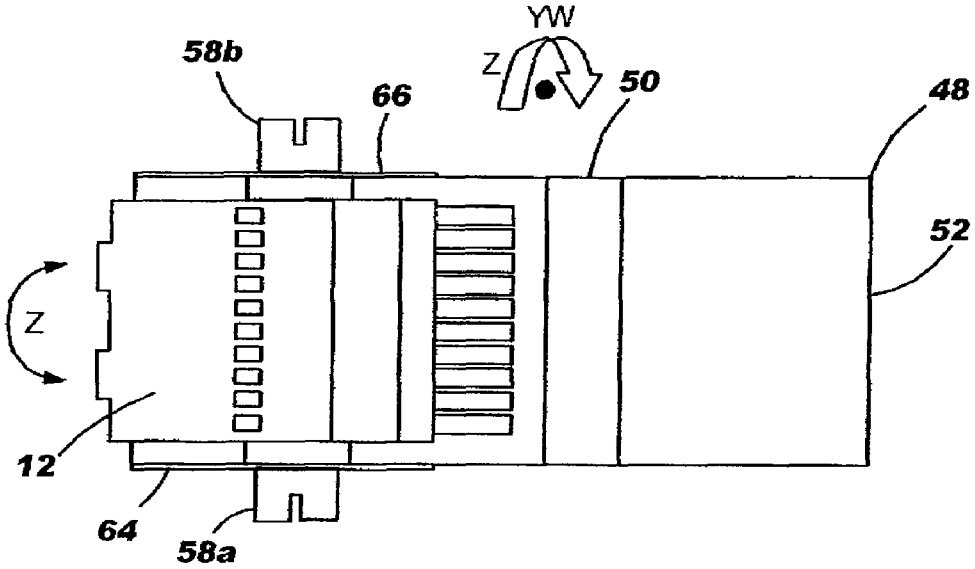
FIG. 6 is a top view of the connector assembly of FIG. 4 illustrating yaw rotation around the Z axis.
Figure 6A:
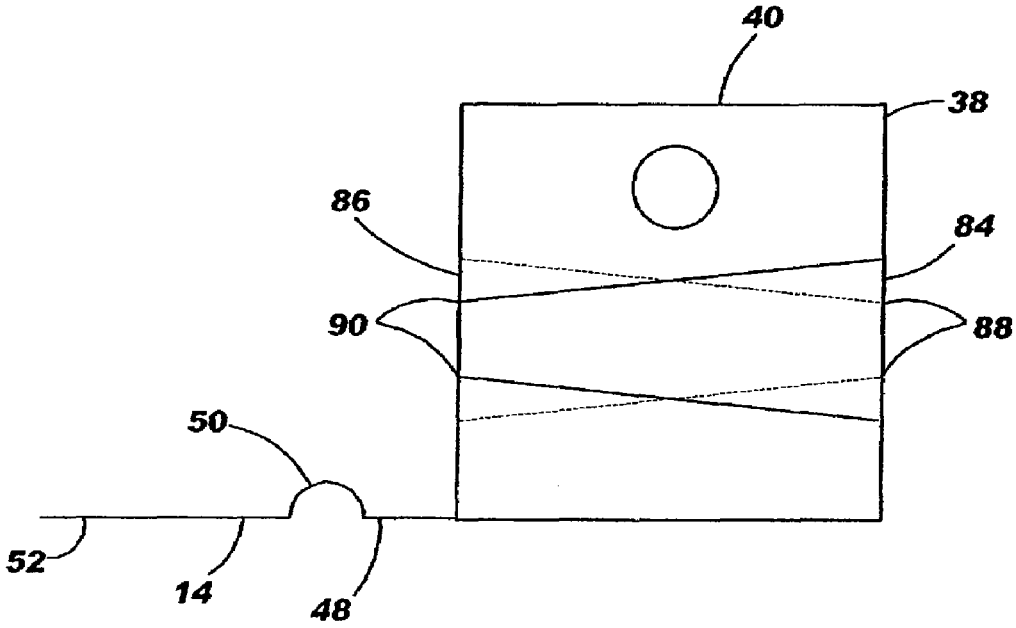
FIG. 6A is a side view of the floating connector spring in FIG. 6 removed from the restrainer and illustrating yaw rotation around the Z axis.

Yaw around the Z axis (also the centerline of the connector 12) is illustrated in FIGS. 6 and 6A. The lobe sections 36, 44 permit the distal ends 32, 40 of the spring arms 30, 38 to twist about the Z axis relative to their proximal ends 34, 42. With further reference to FIG. 3, where a clockwise twist around the Z axis is shown by the arrow 57, the first arm 30 would twist forward in FIG. 3 (to the left in FIG. 6), and the second arm 38 would twist to the rear in FIG. 3 (to the right in FIG. 6). It is also seen that one side of each lobe section 36, 44 would expand while the other side would contract (compress), e.g., in FIG. 3, with a clockwise twist about the Z axis as shown, the front side 80 of the first arm lobe 36 would expand, while the rear side 82 would contract. Similarly, the front side 84 of the lobe section 44 on the second arm would contract while the rear side 86 would expand. This is illustrated in FIG. 6A, the dotted lines 88 representing the lobe edges 76 of the lobe section 44 (FIG. 3) with clockwise rotation around the Z axis (the one lobe side 84 in compression, the other side 86 in expansion), the solid lines 90 representing the lobe edges 76 of the lobe section 36 (not shown) showing the lobe section 36 going from compression on one side of the lobe section to expansion on the other.

Figure 7:
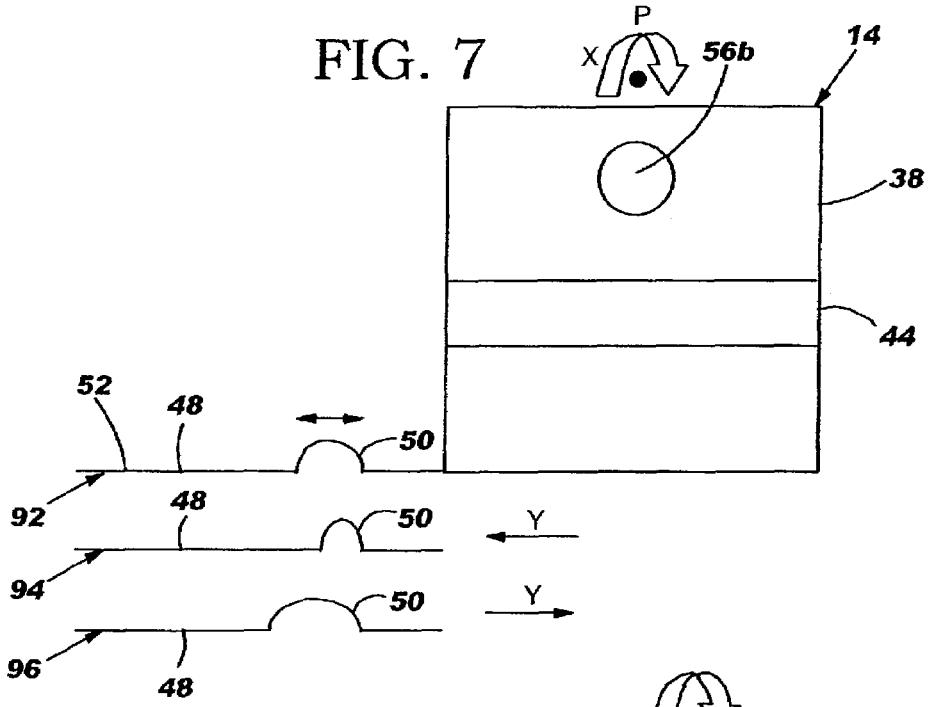
FIG. 7 is a side view of the floating connector spring illustrating linear movement in the directions of the Y axis.

Linear movement back and forth of the connector 12 in the directions of the Y axis is illustrated in FIG. 7, the fixed or non-moving distal end 52 of the arm 48 is shown on the left. The first line 92 shows the third spring arm 48 in its normal non-displaced position. The second line 94 represents the third arm 48 with the lobe section 50 compressed after the connector 12 is moved linearly in the Y axis direction towards the left; the third line 96 represents the third arm 48 with the lobe section 50 expanded after the connector 12 is moved linearly in the Y axis direction towards the right.

Figure 7A:
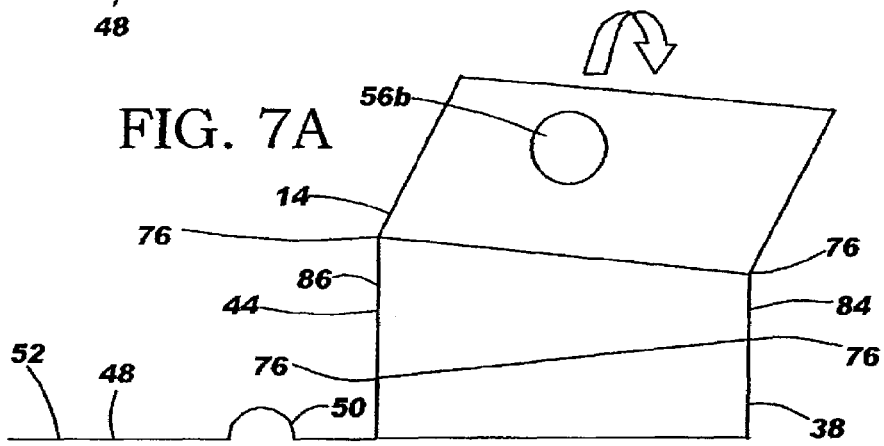
FIGS. 7A and 7B are side views of the floating connector spring illustrating pitch rotation around the X axis.
Figure 7B:
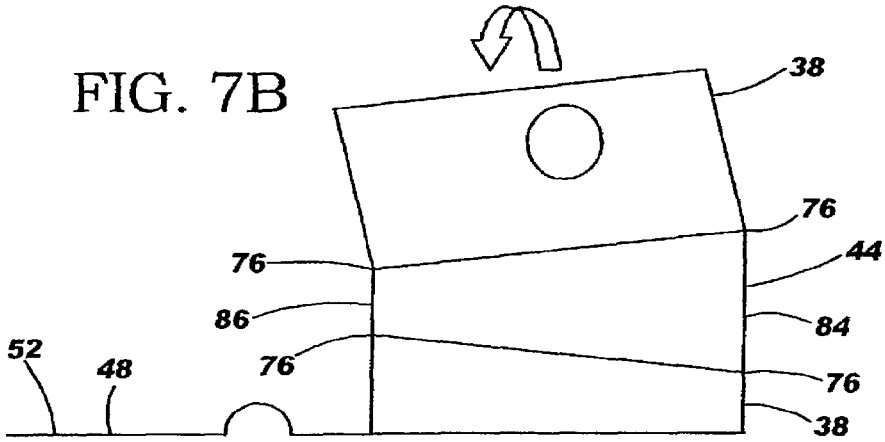

FIGS. 7A and 7*b* illustrated the movement of the connector 12 and the first and second spring arms 30 and 38 as the connector 12 pitches forward and backward, revolving about the X axis (see also FIG. 7). For example, in FIG. 7A, the connector 12, not shown but which is connected to the spring 14 between the openings 56*a*, 56*b*, is pitched forward, causing the front sides 80 and 84 of both lobe sections 36, 44 to compress and the rear sides 82, 86 of the lobe sections to expand. See the lobe edges 76 indicating that the lobe section 44 of the spring arm 38 is in expansion on the left side and compression on the right. The reverse takes place when the connector 12 is pitched rearward as illustrated in FIG. 7B. See the lobe edges 76 indicating that the lobe section 44 of the spring arm 38 is in compression on the left side and expansion on the right.

Figure 8:
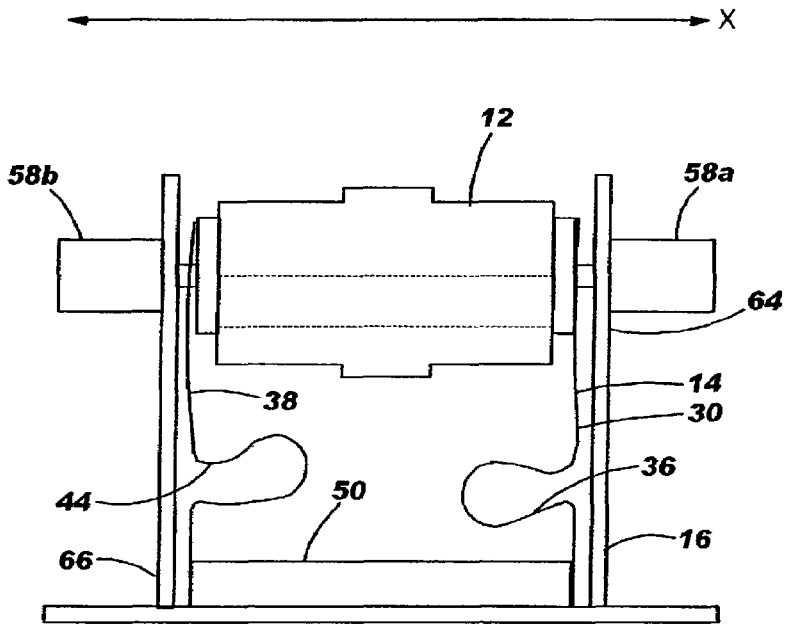
FIG. 8 is a side view of the connector assembly illustrating linear movement in the directions of the X axis.
Figure 8A:
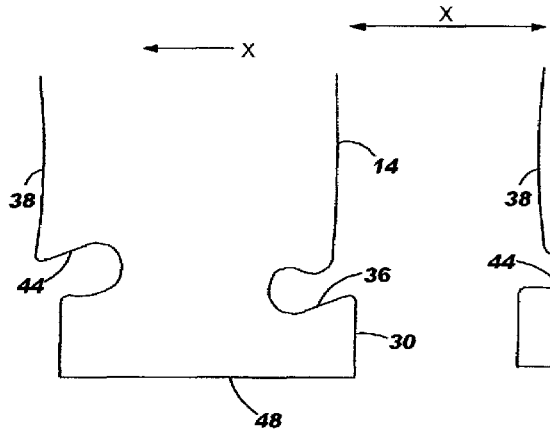
FIGS. 8A and 8B are side views of the floating connector spring illustrating linear movement in the directions of the X axis.
Figure 8B:
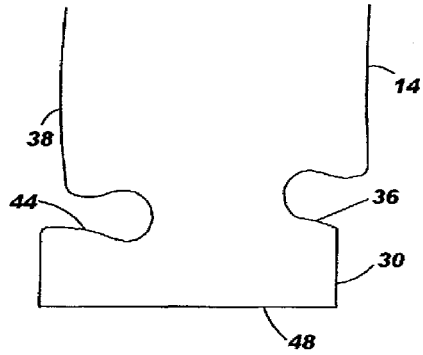

Linear movements in the directions of the X axis are illustrated in FIGS. 8, 8A and 8B. FIG. 8 illustrates movement of the connector 12 to the left, showing the deformations of the lobes 36 and 44. One lobe bends downward while the other bends upward. FIGS. 8A and 8B further illustrate the spring 14 with movement of the connector 12 in the two directions of the X axis, one showing movement to the left and the other showing movement to the right. It should be noted that the movement of the first and second arms 30, 38 linearly in the X directions is similar to that of a four bar linkage, i.e., the connector 12 moves in a parallelogram like motion back and forth in the directions of the X axis with the connector 12 remaining substantially parallel to the third arm 48 which preferably does not move in the X directions.

Figure 9:
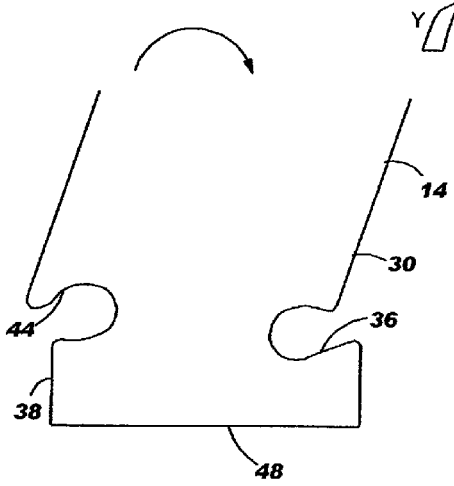
FIGS. 9 and 9A are side views of the floating connector spring illustrating roll rotation around the Y axis.
Figure 9A:
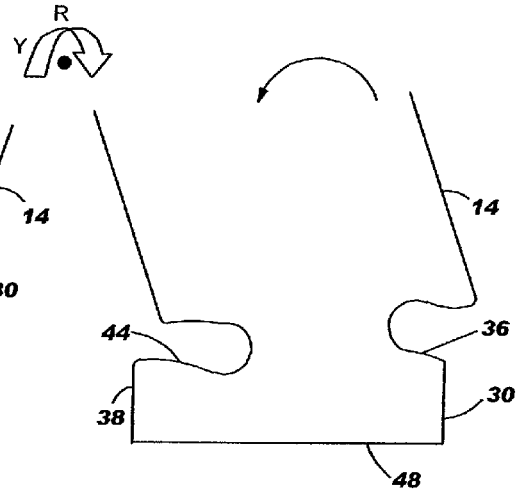

Roll movement about the Y axis is illustrated in FIGS. 9 and 9A. With reference to FIG. 9, the connector spring 14 is shown after clockwise roll movement about the Y axis, causing the first arm lobe section 36 to contract and the second arm lobe 44 to expand as shown. The reverse takes place when the connector spring 14 is rolled counterclockwise about the Y axis as shown in FIG. 9A.

It is understood that the above-described example is merely illustrative of the many possible specific embodiments which represent applications of the present invention. Numerous and varied other arrangements can readily be devised in accordance with the principles of the invention without departing from the spirit and scope of the invention. For example, it is contemplated that in some uses the floating connector spring 14 could be configured without the third arm 48 and its lobe section 50. Such a spring would provide up to five degrees of freedom, all of the degrees of freedom described above except for the linear movement in the directions of the Y axis.

We claim:

1. A floating connector spring capable of providing multiple degrees of freedom for a connector mounted thereto, said connector spring comprising:

first and second spring arms spaced from one another and extending substantially in the same direction, each of said first and second spring arms having a proximal end and a distal end and at least one lobe section positioned between said proximal and distal ends, each of said lobe sections being configured to be resiliently deformable, including being expandable and compressible, to allow movement of the distal ends relative to said proximal ends of said first and second spring arms; and a third arm having a distal end and a proximal end, said third arm being attached to and extending from said first and second arms in a direction different from the direction that said first and second arms extend, said third arm having at least one resiliently deformable lobe section, which is expandable and compressible, positioned between the distal and proximal ends of said third arm to allow movement of said proximal end relative to said distal end of said third arm.

2. The floating connector spring of claim 1 wherein said first, second and third arms are formed as flat spring arms from which said lobe sections extend, and wherein each of said lobe sections have a rounded section.

3. The floating connector spring of claim 2 wherein said first, second and third lobe sections extend in a direction substantially perpendicular from their respective arms, and wherein said first and second arms extend in first and second planes that are substantially parallel to one another.

4. The floating connector spring of claim 2 wherein said first, second and third arms are integrally connected to one another.

5. The floating connector spring of claim 2 wherein at least one of said first and second arms includes an opening adjacent the distal end of said at least one of said first and second arms for receiving a connector stud.

6. The floating connector spring of claim 3 wherein said first and second lobe sections extend towards each other.

7. A spring/restrainer assembly including the floating connector spring of claim 1, and further comprising a restrainer for limiting the movement of said connector spring, said restrainer including a first restrainer arm adjacent to and positioned to limit the linear movement of said first spring arm at least in a one direction, and a second restrainer arm adjacent to and positioned to limit the linear movement of said second spring arm at least in another direction that is different from said one direction.

8. A floating connector assembly in accordance with claim 7 further comprising an electrical connector fixedly attached to said connecting spring between said first and second connector spring arms adjacent to said distal ends of said first and second arms.

9. A floating connector assembly providing multiple degrees of freedom, said floating connector assembly comprising;

a connector spring comprising first and second spring arms spaced from one another and extending substantially in the same direction, each of said first and second spring arms having a proximal end and a distal end and at least one lobe section positioned between said proximal and distal ends, each of said lobe sections being configured to be resiliently deformable, including being expandable and compressible, to allow movement of the distal ends relative to said proximal ends of said first and second spring arms; and a third arm having a distal end and a proximal end, said third arm being attached to and extending from said first and second arms in a direction different from the direction that said first and second arms extend, said third arm having at least one resiliently deformable lobe section positioned between its distal and proximal ends to allow movement of said proximal end relative to said distal end of said third arm;

a restrainer for limiting the movement of said connector spring, said restrainer including a first restrainer arm adjacent to and positioned to limit the movement of said first spring arm, and a second restrainer arm adjacent to and positioned to limit the movement of said second spring arm; and an electrical connector attached to said connector spring between said first and second spring arms adjacent to said distal ends of said first and second spring arms.

10. A floating connector assembly of claim 9 further comprising:

an opening in said first restrainer arm; and a restrainer stud extending from said first spring arm through said opening in said first restrainer arm, wherein the size of said opening in said first restrainer arm is sufficiently larger than said stud so as to allow the desired movement of said stud therein, thereby allowing the desired movement of said connector.

11. The floating connector assembly of claim 10 further comprising:

an opening in said second restrainer arm; and a second restrainer stud extending from said second spring arm through said opening in said second restrainer arm, wherein the size of said opening in said second restrainer arm is sufficiently larger than said second stud so as to allow the desired movement of said second stud therein, thereby allowing the desired movement of said connector.

12. The floating connector assembly of claim 9 wherein said third arm includes an opening for receiving a hold down member for limiting movement of the third arm.

13. The floating connector assembly of claim 11 wherein said first and second studs extend from said connector through openings in said first and second arms of said connector spring and through said openings in said restrainer arms.

14. The floating connector assembly of claim 13 wherein said first and second studs include a non circular cross section, and said openings in said first and second spring arms are non circular such that said stud and said openings in said first and second spring arms cooperate with said studs to prevent rotation of said connector relative to said first and second spring arms.

15. The floating connector assembly of claim 14 wherein said connector spring is made of a spring steel material.

16. The floating connector assembly of claim 9 wherein said restrainer includes a bottom extending substantially perpendicular from and attached to said first and second restrainer arms, said first and second arms of said connector spring being positioned between said first and second arms of said restrainer, and said distal end of said third spring arm being fixedly attached to said restrainer.

17. A floating connector spring capable of movement in multiple degrees of freedom defined by X, Y and Z axes, which axes are substantially perpendicular to one another, said connector spring comprising:

a first arm extending substantially in a direction of the Z axis and having a distal end and a proximal end, and having a first lobe section between said distal and proximal ends;

a second arm extending substantially in the direction of the Z axis spaced from and substantially parallel to said first arm and having a distal end and a proximal end, said second arm having a second lobe section between said distal and proximal ends of said second arm;

said first and second arms comprising a resilient material, and said first and second lobe sections extending in a direction substantially away from the Z axis and are resiliently deformable, including being expandable and compressible, to allow movement of the distal ends relative to the proximal ends of said first and second arms, said movement including parallelogram movement of said first and second arms relative to one another substantially in the directions of the X axis, linear movement of said first and second arms substantially in the directions of the Z axis, rotational movement of said first and second arms about the Z axis; and rotational movement of said first and second arms about the Y axis; and a third arm which is attached to said first and second arms and which extends in a direction different from the direction that said first and second arms extend, said third arm having a distal end spaced from said first and second arms, and said third arm being resilient to allow movement of said first and second arms relative to said distal end of said third arm.

18. The floating connector spring of claim 17 wherein said third arm extends substantially in a direction of the Y axis, has a proximal end, and comprises a resilient material, said proximal end of said third arm being attached to said proximal ends of said first and second arms, said third arm having a third lobe section extending in a direction substantially away from the Y axis and which is resiliently deformable, including being extendable and compressible, to allow linear movement of said first and second arms at least in the direction of said Y axis relative to said distal end of said third arm.

19. A connector spring assembly including the floating connector spring of claim 18 and further comprising a restrainer for limiting the movement of said connector spring, said restrainer including a first restrainer arm adjacent to and positioned to limit the linear movement of said first spring arm in at least one direction along the X axis, and a second restrainer arm adjacent to and positioned to limit the linear movement of said second spring arm in at least another direction along said X axis that is opposite to said one direction along said X axis.

* * * * *